United States Patent [19]

Graff et al.

[11] 4,392,613

[45] Jul. 12, 1983

[54] DISCHARGE GAP CLEANING DEVICE

[75] Inventors: Hart F. Graff; Karl T. Bagdal, both of Middletown, Ohio

[73] Assignee: Armco Inc., Middletown, Ohio

[21] Appl. No.: 218,676

[22] Filed: Dec. 22, 1980

[51] Int. Cl.[3] ..... B05B 15/02

[52] U.S. Cl. ..... 239/115; 239/455

[58] Field of Search ..... 239/455, 114, 115, 123

[56] References Cited

U.S. PATENT DOCUMENTS 2,940,418 6/1980 Penrod et al. ..... 239/455 X 3,053,314 9/1962 McGillis et al. ..... 239/123

FOREIGN PATENT DOCUMENTS 15167 of 1908 United Kingdom ..... 239/115

*Primary Examiner*—John J. Love

*Assistant Examiner*—Gene A. Church

*Attorney, Agent, or Firm*—Frost & Jacobs

[57] ABSTRACT

A device is disclosed for cleaning the discharge gap of a jet nozzle of a web coating line or the like. The cleaning device comprises a body member slidably mounted on or adjacent the jet nozzle in such a way as to be shiftable longitudinally of the jet nozzle between the ends thereof. A clean-out blade is mounted on the body member and has a free end extending into the jet nozzle discharge gap. Manually actuable or mechanical means are provided to shift the body member between the ends of the jet nozzle to cause the free end of the clean-out blade to clean the jet nozzle discharge gap.

10 Claims, 3 Drawing Figures

DISCHARGE GAP CLEANING DEVICE

TECHNICAL FIELD

The invention relates to a discharge gap cleaning device for a jet nozzle, and more particularly to such a device which can be moved along the nozzle body, cleaning the discharge gap thereof by means of a blade extending into the gap opening.

BACKGROUND ART

Jet nozzles of the type to which the present invention is directed are well known in the art. They are used in association with coating lines for applying a coating to a continuous web or strip of substrate such as cloth, paper, film, foil or metallic strip. The substrate continuous web or strip is coated with the desired coating material by any appropriate means such as means for spraying the coating material on the web or means for causing the web to pass through a bath of the coating material. While the coating material is still in a liquid state on the substrate web, the web is caused to pass by or between one or more jet nozzles. The jet nozzles comprise elongated members located close to the web surface or surfaces and extending transversely thereof. The jet nozzles each have an elongated discharge gap, also extending transversely of the web, through which a fluid medium (generally a gaseous medium) is cause to impinge upon the web surface or surfaces. In this way, the jet nozzle or nozzles are used to remove excess coating material and to render the coating more uniform throughout the width of the web or strip. Jet nozzles, in some coating operations, have also been used as back-up or support means for the web.

While not intended to be so limited, for purposes of an exemplary showing, the present invention will be described in its application to jet nozzles used in association with metallic coating lines for applying a molten coating metal to the surface or surfaces of a base metal strip. For example, it is common practice to utilize jet nozzles as finishing means in coating lines for coating a ferrous base metal strip with a molten coating metal such as zinc, zinc alloys, aluminum, aluminum alloys, terne and lead.

When the coating operation is a conventional hot-dip operation, jet knives are located to either side of the strip as it exits the bath of molten coating metal. The jet knives are located quite close to the strip surfaces and direct a finishing medium against the strip surfaces. The finishing medium may be air, steam, nitrogen or an inert gas.

In the typical coating operation, coating splashback can occur with the result that there can be coating metal build-up within the jet nozzle discharge gap. It is not uncommon to locate the jet nozzles directly opposite each other on either side of the coated strip. Under these circumstances, additional coating metal can be blown by one jet nozzle into the other. If the build-up of coating material within the jet nozzle gap, or on the lips of the jet nozzles which define the gap, becomes excessive, uniform coating weight control is impaired; coating streaks can occur; and the built-up coating metal can even scratch the surfaces of the coated strip.

Foreign particles originating from the internal chamber of the jet nozzle can also become lodged in the gap. The particles are forced into the gap by the finishing medium. If not removed, they can cause non-uniform coatings or coating streaks.

Removal of coating metal build-up on the jet nozzle lips or in the jet nozzle discharge gap is frequently difficult because of the inaccessibility of the jet nozzles. This is particularly true where the finishing step is performed in an enclosed atmosphere, such as is taught in the one-side coating procedures set forth in U.S. Pat. Nos. 4,082,868; 4,114,563 and 4,152,471. U.S. Pat. No. 4,330,574 teaches enclosed finishing utilizing jet nozzles within an enclosure.

The necessity for cleaning the jet nozzles and the problems attendant therewith have long been recognized by the worker in the art. In many instances it has simply been necessary to shut down the line, and remove the jet nozzles for cleaning purposes. Jet nozzles have been made of a clam shell construction to facilitate the cleaning thereof. Such jet nozzles are taught, for example, in U.S. Pat. No. 3,314,165.

Another approach by prior art workers has been to use a wire brush or a small diameter wire mounted on the end of a long handle means. The brush is forced against the nozzle gap and moved therealong, or the wire (bent at right angles) is positioned within the gap and moved the length of the nozzle. Both of these methods are difficult to perform, particularly when the nozzle gap is in close proximity to the strip. Furthermore, both methods require that the operator be subjected to heat and hot nitrogen or air blasts.

Other methods have been devised both for cleaning air nozzles and for preventing the build-up of coating material on the lips or within the discharge gap of the air nozzles. For example, jet nozzles have been provided with a rod located internally of the jet nozzle, with one end of the rod extending through the end plate of the nozzle body. Within the nozzle, a thin metal blade is mounted on the rod. The thin metal blade extends through the nozzle gap and the rod is shifted manually to cause the blade to traverse the length of the nozzle gap for cleaning purposes. U.S. Pat. No. 2,135,406 teaches a jet nozzle provided with means whereby a portion of the finishing medium within the nozzle and under pressure is channeled to a distribution chamber located on the bottom exterior surface of the nozzle. From the distributing chamber, the air exits through a narrow slot or opening which directs the air under pressure onto the bottom surface of the nozzle and directly across that portion of the nozzle where coating material often tends to accumulate. U.S. Pat. No. 2,679,231 utilizes secondary air and a specially configured baffle means to avoid build-up of the coating material.

The present invention provides a cleaning means which can be mounted adjacent to or directly on the jet cleaning nozzle. The mounting is such that the cleaning device, having a blade extending into the discharge gap of the nozzle, can be readily made to traverse the length of the nozzle (with the blade cleaning the gap) by means of an elongated pole, or preferably by motorized operation which requires no access to the jet nozzle by the operator and eliminates subjecting of the operator to jet blast, heat and the like.

DISCLOSURE OF THE INVENTION

In accordance with the invention there is provided a device for cleaning the discharge gap of a jet nozzle of a web coating line or the like. The cleaning device comprises a body member mounted exteriorly of the jet nozzle. Preferably, the body member is slidably mounted directly on the jet nozzle, on means serving as a guide or way for the body member. The body member is shiftable longitudinally of the jet nozzle between the ends thereof along the guide or way means.

A clean-out blade is removably mounted on the body member. The clean-out blade has a free end which extends downwardly and rearwardly into the jet nozzle discharge gap. As the body member is shifted longitudinally from one end of the jet nozzle to the other, the clean-out blade removes coating metal build-up from the lips and discharge gap of the jet nozzle. It also removes any foreign particles lodged in the discharge gap.

The upper surface of the body member may be provided with a socket-forming perforation for engagement by a ball-like structure mounted on the end of an elongated pole. By this means, the operator can manually shift the body member to cause the clean-out blade to remove the built-up coating metal from the lips and discharge gap of the nozzle. Since the body member is mounted adjacent to or directly upon the jet nozzle, the cleaning operation can be accomplished without line shut down and despite the fact that the nozzle may be located quite close to the adjacent coated strip surface.

In a preferred embodiment, shifting of the body member and its clean-out blade is accomplished by motor means. The motor means, itself, may be operator controlled or fully automatic.

BEST MODE OF CARRYING OUT THE INVENTION

Figure 1:
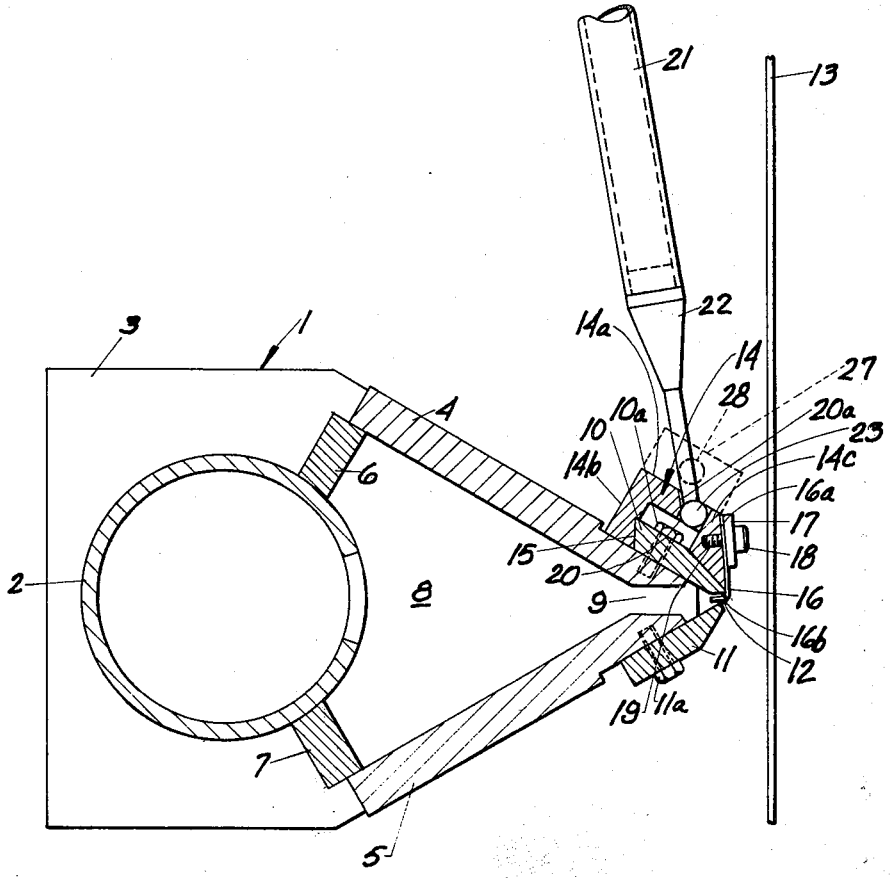
FIG. 1 is a fragmentary side elevational view, partly in cross section, illustrating an exemplary jet nozzle provided with the cleaning device of the present invention.

Reference is first made to FIG. 1 wherein an exemplary jet nozzle is generally indicated at 1. Jet nozzles have been devised, having many different constructions and configurations. The nozzle 1 of FIG. 1 is exemplary only, since the particular configuration and construction of the jet nozzle does not constitute a limitation of the present invention. The jet nozzle 1 comprises a supply pipe or manifold 2 which extends between a pair of substantially mirror image end plates 3 and 3*a*. The manifold 2 is connected to a source of gaseous finishing medium by conventional means, not shown. An upper plate 4 and a lower plate 5 extend between and are affixed to the end plates 3 and 3*a* respectively. A pair of baffle plates 6 and 7 are affixed to the manifold 2, the end plates 3 and 3*a*, the upper plate 4 and the lower plate 5. The manifold 2, the end plates 3 and 3*a*, upper plate 4, lower plate 5 and baffles 6 and 7 define a plenum chamber 8.

It will be noted that the upper plate 4 and lower plate 5 are spaced from each other at their forward edges, providing a gap 9. While the gap 9 may constitute the discharge gap of the jet nozzle 1, the more common practice is to provide an upper lip 10 and a lower lip 11, removably affixed to upper plate 4 and lower plate 5, respectively, by a plurality of bolts 10*a* and 11*a*. The lips 10 and 11 are removably affixed to their respective plates 4 and 5 for purposes of replacement and may be provided with slotted perforations for receipt of the bolts 10*a* and 11*a* so as to be adjustable, so that the discharge gap 12, defined by the lips, can be adjusted.

In FIG. 1 a coated ferrous base metal strip is shown at 13 in vertical flight. The strip 13 will have just exited the coating means, such as a coating pot (not shown) and the coating metal on the strip will still be molten as it passes nozzle 1. When a conventional two-side, hot-dip coating procedure is used, it will be understood by one skilled in the art that a second jet nozzle, similar to nozzle 1, will be located on the other side of strip 13. The other jet nozzle (not shown) may be located directly across from nozzle 1 or somewhat above or below it. It will further be understood by one skilled in the art that appropriate support means (not shown) will be provided to maintain jet nozzle 1 in position.

The cleaning device of the present invention comprises a block-like body member generally indicated at 14. The block-like body member 14 is slidably mounted on an appropriate guide means or way located adjacent to or directly on the jet nozzle 1. The important feature is that the body member 14 be slidable in a guided path between end plates 3 and 3*a*. This can be accomplished in many ways. For example, the end plates 3 and 3*a* could be provided with upwardly extending lugs supporting a pair of parallel, shaped rods extending therebetween. The rods could pass through appropriate perforations in body member 14 and serve as guides therefor. On the other hand, some appropriate form of track or way could be mounted directly on upper plate 4 or directly on the top surface of upper lip 10.

In the embodiment illustrated in FIG. 1, which is exemplary only, the upper lip 10 is used to serve as the guide or way for body member 14. To this end, the body member 14 has an inverted U-shaped configuration with a base portion 14*a* and a pair of downwardly depending legs 14*b* and 14*c*. The leg 14*b* is intended to ride directly on the upper surface of upper plate 4. While the leg 14*b* may simply abut the rear surface of upper lip 10, the leg 14*b* and the rear surface of upper lip 10 may be given an undercut-dove tail configuration as is shown at 15.

The other downwardly depending leg 14*c* of body member 14 rests upon the upper surface of upper lip 10 near its forward end.

An L-shaped clean-out blade 16 is provided. One leg 16*a* of blade 16 is adapted to lie along the forward surface of body member 14. The other leg 16*b* of blade 16 extends into the jet nozzle discharge gap 12. The blade 16 is replaceably and removably affixed to the body member 14 by means of a retainer plate 17 and a pair of bolts 18 (see also FIG. 2). The leg 14*c* of body member 14 has a pair of threaded perforations, one of which is shown at 19 in FIG. 1, for the receipt of the bolts 18. To this end, the blade 16 and retainer 17 are provided with perforations (not shown) coaxial with the threaded perforations in leg 14*c* through which bolts 18 pass with clearance. The perforations through blade 16 may, if desired, be elongated so that the position of leg portion 16*b* of blade 16 within the discharge gap 12 can be adjusted. It will be noted from FIG. 1 that the leg 16*b* of blade 16 need not physically contact either of upper lip 10 or lower lip 11 at gap 12. It will be understood, however, that the dovetail engagement 15 between body member leg 14*b* and the rear end of upper lip 10, together with the inturned leg 16*b* of blade 16 will assure that the body member 14 cannot be inadvertently dislodged from nozzle 1.

Figure 2:
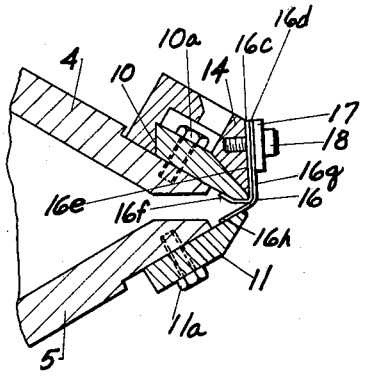
FIG. 2 is a fragmentary, enlarged, side elevational view, partly in cross section, illustrating another embodiment of blade means.

In FIG. 2 a two-piece blade is illustrated, comprising blade elements 16*c* and 16*d*. Each of elements 16*c* and 16*d* are similar to blade 16 of FIG. 1, element 16*c* having a first leg 16*e* adapted to lie along the forward surface of body member 14 and having a pair of perforations for receipt of bolts 18 and a second leg 16*f* extending into discharge gap 12. Blade element 16*d* has a first leg 16*g* equivalent to leg 16*e* and having perforations for bolts 18, and a second leg 16*h* extending into discharge gap 12. The legs 16*f* and 16*h* are configured to more closely clean lips 10 and 11, respectively, as can be clearly seen in FIG. 2. The blade elements 16*c* and 16*d* are abutted and bolted to leg 14*c* of body member 14 in the same manner described with respect to blade 16, utilizing bolts 18 and retainer plate 17.

In usual practice, the nozzle 1 and its gap 12 are of greater length than the width of strip 13. Thus, when not in use, the body member 14 and its blade 16 are simply located at one end or the other of gap 12 beyond the adjacent edge of strip 13. To clean the gap 12 it is only necessary to traverse the body member 14 and its blade 16 along gap 12 one or more times.

Traversing the body member 14 and its blade 17 can be accomplished in several ways. First of all, it can be performed manually by the operator. To this end, the upper surface of body member 14 may be provided with a perforation 20, relieved at its upper end as at 20*a* so as to form a socket. The operator may be provided with an elongated pole 21 having at its end a fitting 22 terminating in a ball 23 adapted to be received in the hole or socket 20. With ball 23 located in socket 20, the operator can use pole 21 to shift the body member 14 and its blade 16 back and forth across the length of gap 12. The arrangement of ball 23 and socket 20 serves as a sort of universal joint so that the pole 21 can readily be maintained in engagement with the body member 14 despite changes in their relative angularity during the shifting of the body member 14.

Figure 3:
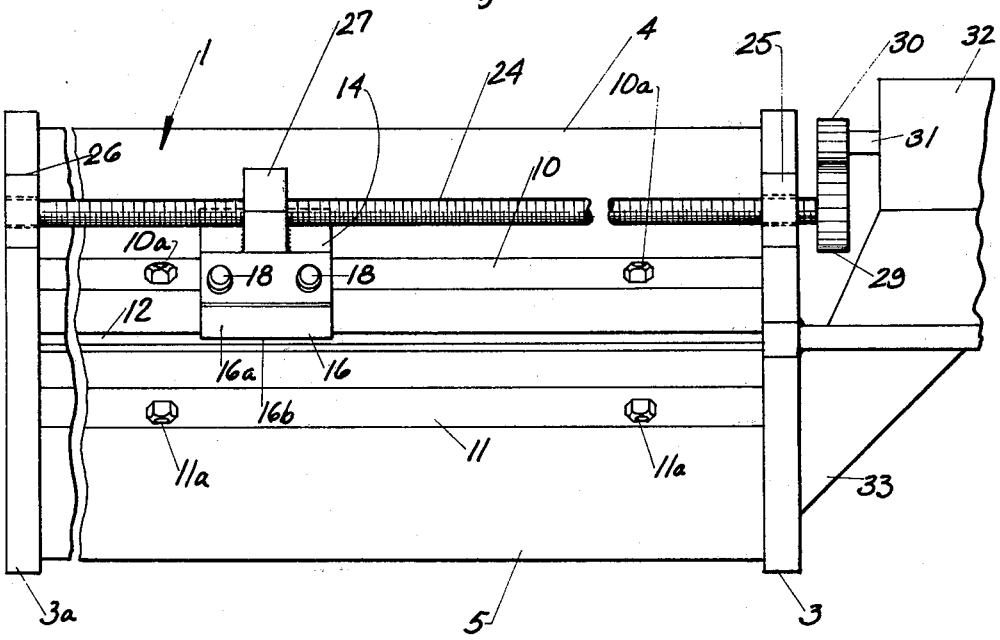
FIG. 3 is a fragmentary front elevational view of the jet nozzle, provided with the cleaning device of the present invention in its motorized form.

As indicated above, in some instances the jet nozzle 1 may be difficult to reach by means of pole 21. In those coating lines wherein the jet finishing is accomplished in an enclosure so as to maintain the strip 13 in a controlled atmosphere during finishing, the use of manual means such as pole 21 is substantially precluded. It is therefore within the scope of the present invention to provide a motor or the like to drive the body member 14 along its path of travel across the nozzle 1. To this end, reference is made to FIG. 3. The body member 14 may be motor driven many ways such as through the agency of a rack and pinion, by means of a fluid cylinder or the like. FIG. 3, wherein like parts have been given like index numerals, illustrates an exemplary motor drive.

In FIG. 3 a rod 24 is shown, extending the length of the nozzle assembly 1. The rod 24 is mounted for rotation in appropriate bearings 25 and 26. The bearing means 25 and 26 may, for example, be mounted on the end plates 3 and 3*a*, respectively, of nozzle assembly 1. The bearing means 25 and 26 may constitute an integral part of end plates 3 and 3*a*. That portion of rod 24 extending between bearing means 25 and 26 is threaded, as shown.

The upper surface of body member 14 is provided with an upstanding lug 27. Lug 27 is shown in FIG. 1 in broken lines and has a transverse perforation 28 extending therethrough which is internally threaded. The threads of perforation 28 (see FIG. 1) are engaged with the threads of rod 24. As a consequence, as rod 24 is rotated in a first direction, the body member 14 will be traversed across the nozzle assembly 1 in a first direction, similarly, as rod 24 is rotated in a second direction, the body member 14 will traverse the nozzle assembly in a second direction.

Rod 24 is operatively connected to a prime mover, by which rotation is imparted thereto. In the exemplary showing of FIG. 3, rod 24 extends beyond bearing means 25 and has a gear 29 mounted on its end. The gear 29 is adapted to cooperate with the gear 30 on the shaft 31 of a motor 32. The motor 32, in turn, is supported by a bracket means 33 affixed to nozzle assembly end plate 3.

Appropriate means may be provided to reverse the direction of rotation of motor shaft 31 when body member 14 reaches one end or the other of its path of travel. The rod 24 may have a double thread thereon so that the motor shaft 31 can turn in the same direction at all times. Means may be provided to enable the operator to actuate the motor, or actuation of the motor may be automatic or timer-controlled. It would even be within the scope of the invention to provide the end of threaded rod 24 with a hand crank actuable by the operator. In instances wherein the finishing is accomplished within an enclosure such as in a protective atmosphere, shaft 24 may extend through appropriate sealing means to a position outside the enclosure so that motor 32 can be mounted exteriorally thereof.

Modifications may be made in the invention without departing from the spirit of it.

What is claimed is:

1. A device for cleaning the discharge gap of a jet nozzle of the type used in conjunction with a web coating line and constituting an elongated nozzle structure located in close proximity to the coated web and extending transversely of said coated web with its ends extending beyond the edges of said coated web and its discharge gap also extending transversely of said coated web and being of a length greater than the width of said coated web, said cleaning means comprising a body member, means to shiftably mount said body member in a path of travel extending parallel to and along the length of said jet nozzle, a clean-out blade on said body member, said clean-out blade having a free end extending into said jet nozzle discharge gap and remaining there at all times, and means to shift said body member back and forth along said path of travel, said cleaning means being located at one end or the other of said discharge gap when not being shifted along said path of travel.

2. The structure claimed in claim 1 wherein said means to shiftably mount said body member in said path of travel comprises a part of said jet nozzle.

3. The structure claimed in claim 1 wherein said clean-out blade is replaceably affixed to said body member.

4. The structure claimed in claim 1 wherein said clean-out blade is adjustably affixed to said body member.

5. The structure claimed in claim 1 wherein said means to shift said body member comprises manually actuated means.

6. The structure claimed in claim 1 wherein said means to shift said body member comprises a prime mover-actuated means.

7. The structure claimed in claim 1 including a pair of lips affixed to said jet nozzle and extending longitudinally thereof in parallel spaced relationship, said lips defining said discharge gap.

8. The structure claimed in claim 1, wherein said clean-out blade is substantially L-shaped, said clean-out blade having a first leg affixed to said body member and a second leg extending into said discharge gap.

9. The structure claimed in claim 1 wherein said clean-out blade comprises a pair of substantially L-shaped elements, each of said elements having a first leg, said first legs being superposed one upon the other and affixed to said body member, each of said elements having second legs extending into said discharge gap and diverging from each other so as to clean substantially the full width of said discharge gap.

10. The structure claimed in claim 7 wherein said clean-out blade comprises a pair of substantially L-shaped elements, each of said elements having a first leg, said first legs being superposed one upon the other and affixed to said body member, each of said elements having second legs extending into said discharge gap and diverging from each other so that said second leg lies adjacent one of said lips.

* * * * *